US005107628A

United States Patent [19]

Kondo et al.

[11] Patent Number: 5,107,628

[45] Date of Patent: Apr. 28, 1992

[54] METHOD OF FABRICATING ARTICLE HAVING ASPHERIC FIGURE AND TOOL FOR USE IN CARRYING OUT THE METHOD

[75] Inventors: Yoshimasa Kondo, Koganei; Shigeo Moriyama, Tama; Akira Arimoto, Kodaira; Koji Takahashi, Ibaraki; Kenichi Kugai, Katsuta, all of Japan

[73] Assignees: Hitachi, Ltd.; Hitachi Koki Co., Ltd., both of Tokyo, Japan

[21] Appl. No.: 390,107

[22] Filed: Aug. 7, 1989

[30] Foreign Application Priority Data

Aug. 12, 1988 [JP] Japan ..... 63-199910

[51] Int. Cl.[5] ..... B24B 5/00

[52] U.S. Cl. ..... 51/284 R; 51/165.77; 51/165.76; 51/105 LG; 51/124 L

[58] Field of Search ..... 51/284 R, 165.77, 165.76, 51/284 E, 95 R, 106 LG, 105 LG, 326, 327, 124 L

[56] References Cited

U.S. PATENT DOCUMENTS 4,010,574 3/1977 Feierbend et al. ..... 51/165.77

4,862,646 9/1989 Briones ..... 51/124 L

FOREIGN PATENT DOCUMENTS 2029378 10/1970 France .
59-115153 7/1984 Japan .
62-176747 3/1987 Japan .
62-203744 8/1987 Japan .
63-216664 9/1988 Japan .
1292202 10/1972 United Kingdom .

*Primary Examiner*—Robert A. Rose
*Attorney, Agent, or Firm*—Fay, Sharpe, Beall, Fagan, Minnich & McKee

[57] ABSTRACT

A method of and apparatus for fabricating an article having an aspheric figure, wherein the three-dimensional positional relationship between a work and a grinding spindle as a processing tool is controlled in terms of a polar coordinate system. The grinding spindle extends in a plane which is perpendicular to the direction of rotation of said work and is made to swing along an arcuate path. The distance between the axis of rotation of the work and the axis of the swing of the grinding spindle is changed in relation to the rotational angular position of the work.

14 Claims, 3 Drawing Sheets

METHOD OF FABRICATING ARTICLE HAVING ASPHERIC FIGURE AND TOOL FOR USE IN CARRYING OUT THE METHOD

BACKGROUND OF THE INVENTION

The present invention relates to fabricating an article having a toric-like aspheric figure. More particularly, the present invention is concerned with a method for use in fabricating an aspheric lens having a similar toric surface in which the sub-radius of the aspheric lens varies depending on the position.

As disclosed in Japanese Patent Unexamined Publication No. 62-203744, a typical known method for fabricating a toric lens employs a lapping tool having a configuration complementary to the configuration of the lens to be obtained. The lapping method is effected such that the lens is formed by lapping namely, by pressing the glass material to the rapping tool through the intermediary of a lapping powder supplied into the space between the lapping tool and the glass.

On the other hand, Japanese Patent Unexamined Publication No. 62-176747 discloses a method and an apparatus for processing a toric figuration by a combination of rotations about two axes.

The method disclosed in Japanese Patent Unexamined Publication No. 62-203744 only enables fabrication of a toric configuration which is shown by a broken line in FIG. 2. On the other hand, it has been known that, in some uses of aspheric lenses such as an optical component of a laser beam printer, the optical image property can significantly be improved by the use of a similar toric lens having a surface which is slightly deviated from a toric form. In this field of industry, therefore, there is a demand for an efficient method for fabricating a lens having a similar toric surface.

SUMMARY OF THE INVENTION

Accordingly, an object of the present invention is to provide a fabrication method suitable for fabricating an article having a nonaxissymmetric figure in which the sub-radius continuously varies according to the position such that the figure deviation from the basic toric surface is about 100 microns or so at the greatest.

To this end, according to the present invention, the three-dimensional relative position between a work and a grinding wheel as the fabricating tool is controlled at a high speed in terms of a polar coordinate system. More specifically, while the work is being rotated at a low speed, the grinding spindle of the tool is swung along an arcuate path within a plane which is perpendicular to the direction of rotation of the work. The distance between the axis of rotation of the work and the axis of the swinging motion of the grinding spindle is varied in accordance with the angle of rotation of the work.

Thus, according to the above-mentioned fabrication method the grinding wheel grinds the work while the distance between the axis of rotation of the work and the axis of swinging of the grinding spindle is varied in accordance with the angle of rotation of the work. In addition, the grinding spindle is slightly moved stepwise while renewing the aspheric figure data each time the grinding spindle is moved, so that a similar toric surface with a slight deviation from the basis toric form, i.e., a nonaxissymmetrical aspheric figure, can be fabricated.

DESCRIPTION OF THE PREFERRED EMBODIMENTS

Figure 1:
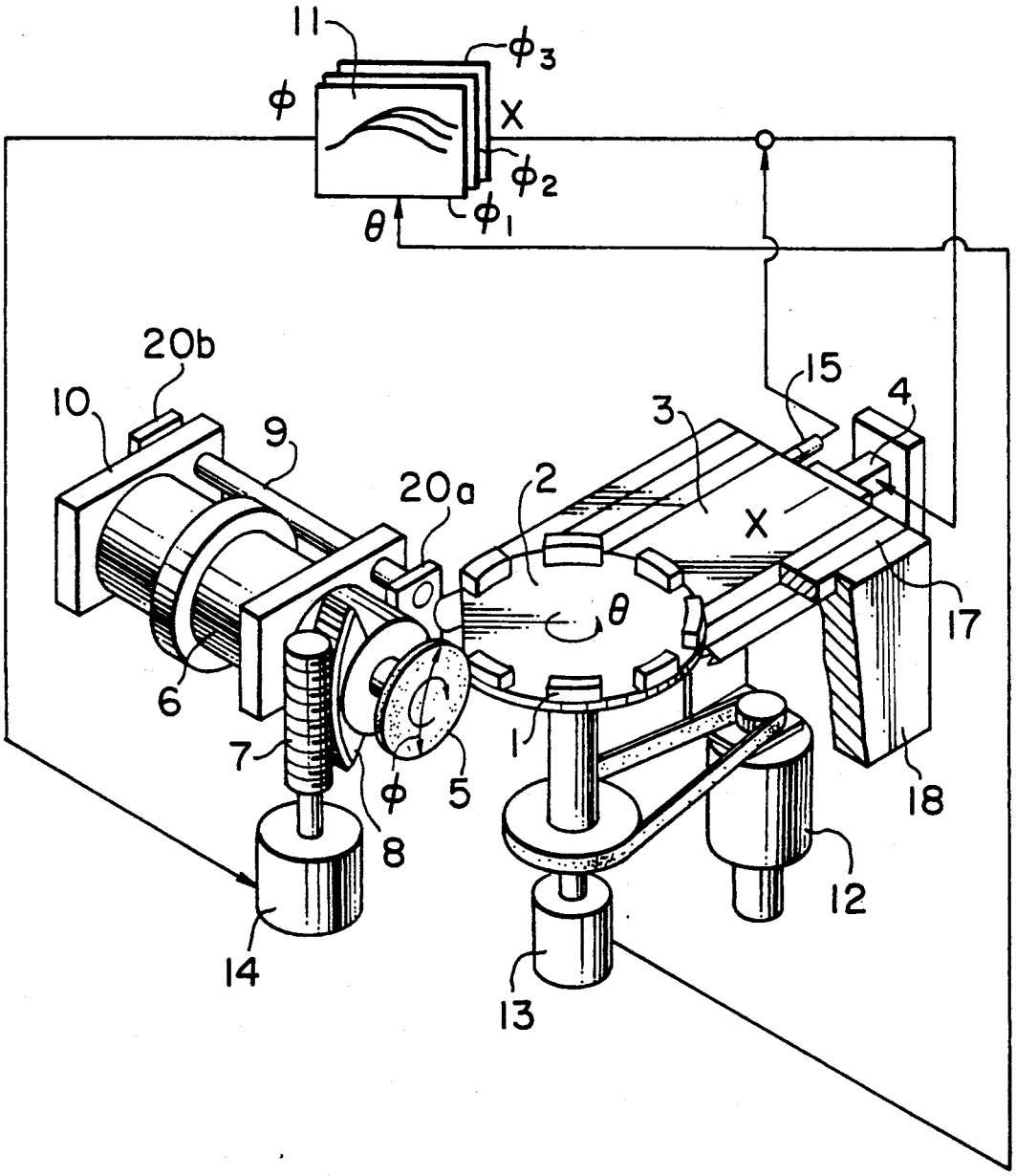
FIG. 1 is an illustration of an apparatus for carrying out an embodiment of the method in accordance with the present invention for fabricating an aspheric lens.

An embodiment of the present invention will be described with reference to FIG. 1 which shows an apparatus for carrying out the method for fabricating an aspheric lens in accordance with the present invention. A plurality of works 1 are rotated by a rotary table 2 which is rotatingly driven by a motor 12. The rotary table 2 is carried by a linear table 3 which is movable back and forth along an X axis represented by X. The linear table 3 is mounted on a base 18 through a guide 17. The linear table 3 is driven by a piezo actuator 4. A grinding wheel 5 for grinding the work 1 is secured to an air spindle 6 which rotates with high accuracy at a speed of 10,000 rpm or so. The air spindle 6 is constructed in such a manner as to be able to swing arcuately around an air spindle swing shaft 9 which extends in parallel with the axis of rotation of the air spindle 6, through an angle represented by $\phi$, by virtue of a worm gear 7 and a worm wheel 8. Both ends of the air spindle swing shaft 9 are supported by two bearings on supporting frames 20*a* and 20*b*.

Before commencing an explanation of aspheric figure processing, a brief description will be given of the fabrication of a toric surface because the aspheric figure to be fabricated is based upon a toric surface.

Figure 3:
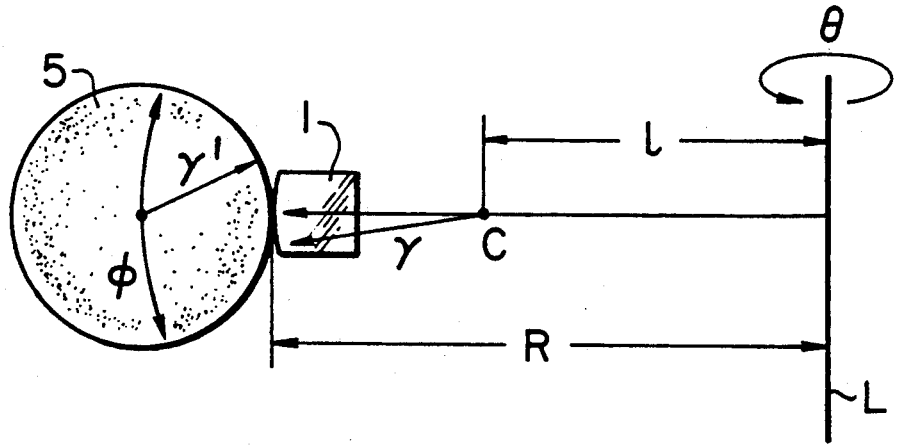
FIG. 3 is an illustration of the geometrical relationship between a grinding wheel, a work, an axis of swinging of the grinding spindle and an axis of rotation of the work.

FIG. 3 shows positional relationship between the axis C of rotation of the air spindle swing shaft 9 and the axis L of rotation of the rotary table 2, as well as the positional relationship between the work 1 and the grinding wheel 5.

Figure 2:
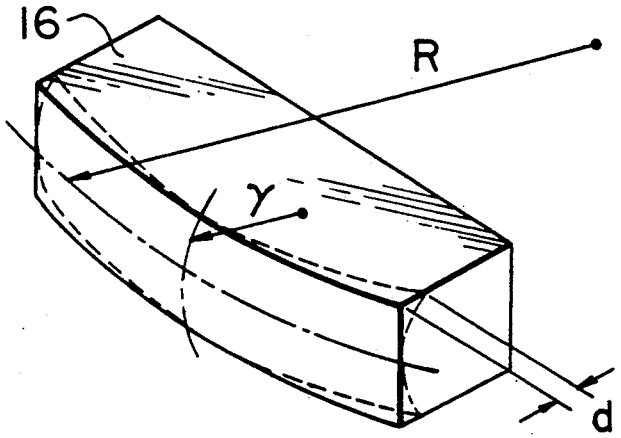
FIG. 2 is a perspective view of the aspheric lens to be fabricated.

As will be seen from this Figure, the position of the axis of the air spindle 6 is so determined that the distance between the surface of the work 1 and the axis L of rotation of the rotary table 2 is equal to the main radius R of the lens 16 (see FIG. 2), and that the distance between the axis C of the air spindle swing shaft 9 and the surface of the grinding wheel 5 equals the sub-radius r of the lens 16. As the first step of the process, the worm gear 7 is rotated so as to arcuately swing the air spindle 6 to bring the grinding wheel 5 to the lower end of the work 1 at which the grinding is to be commenced. Meanwhile, the rotary table 2 is rotated at a slow speed of several rpm. Then, the grinding wheel 5 is started to rotate while applying a grinding liquid, and the piezo actuator 4 is energized by an electrical voltage so as to cause a forward displacement of the linear table 3. The actual forward displacement of the linear table 3 is measured by a non-contact displacement gauge 15 so that the grinding depth is always controlled precisely in conformity with a given grinding depth instruction. The forward displacement of the linear table 3 brings the work 1 into contact with the grinding wheel 5 so that the work is ground. Since the work 1 is being rotated, the grinding wheel 5 grinds a narrow strip-like zone of the work 1 as the table 2 rotates. When the grinding of the narrow strip-like zone is finished with all the works 1 on the rotary table 2 after one full rotation of the rotary table 2, a predetermined pulse signal is applied to the pulse motor 14 so as to cause a slight rotation of the worm gear 7, so that the air spindle 6 finely swings upward. Namely, the grinding wheel 5 is moved slightly upward through a minute angle $\Delta\phi$ along the surface at the sub-radius r into contact with a new narrow strip-like zone of the work surface. This operation is repeated until the grinding wheel 5 grinds all the works 1 up to the uppermost end of these works 1. In consequence, a curved line of the sub-radius r is generated and, at the same time, the curved line is rotated at the main radius R so that a toric surface is generated, whereby each work is configured into a toric figure as shown by broken line in FIG. 2.

A description will be given of the method of fabricating the aspheric surface. As is the case of the formation of the toric surface explained above, the grinding wheel 5 is moved to the lower end of the work 1 at which the grinding is to be commenced. Then, the rotary table 2 is rotated. In the fabrication of the aspheric figure, the rotation angle $\theta$ of the rotary table 2 is precisely detected by means of, for example, a rotary encoder 13 which is directly coupled to the rotary shaft of the rotary table 2. On the other hand, the air spindle 6 is swung stepwise to change its position upon completion of each rotation of the rotary table 2, as in the case of the fabrication of the toric surface. That is, the position of contact of the grinding wheel 5 with the work 1 is progressively changed. In this embodiment, a group of processing data 11 is beforehand calculated and obtained for each of the stepwise angular position $\phi_1$, $\phi_2$, $\phi_3$ and so forth, using the rotation angle $\theta$ as a parameter, and stored in a suitable memory. In operation, the processing data 11 is read from the memory in accordance with the pulses derived from the rotary encoder 13 representing the rotation angle $\theta$ of the rotary table 2. The processing data 11 thus read from the memory is supplied to the piezo actuator 4 so that the piezo actuator 4 operates to continuously drive the linear table 3 back and forth. In consequence, the grinding depth is consecutively changed during the grinding of the work 1 by the grinding wheel 5 at each stepwise angular position of the air spindle 6. Namely, the grinding depth is continuously controlled in accordance with the processing data 11.

When the rotary table 2 has completed one full rotation, the air spindle 6 is swung stepwise by a minute angle $\Delta\phi$, so as to bring the grinding wheel 5 to a new position with respect to the work 1 to grind a new region of the work surface. At the same time, processing data 11 corresponding to this new angular position of the air spindle 6 is read from the memory and the above-described grinding operation is executed with the thus read new processing data. This operation is repeated until the grinding wheel 5 finishes the grinding up to the uppermost end of the work surface, whereby all the works are ground such that each of the works has an aspheric surface the sub-diameter r of which varies according to the position $\theta$, i.e., a similar toric surface deviated from the toric surface in an amount represented by d as shown by a distance between the solid line similar toric surface and the broken-line toric surface shown in FIG. 2. The above-mentioned processing data 11 is numerical data which is formed by dividing the surface of the lens 16 into a plurality of small sections, for each step of the minute angular displacement $\Delta\phi$, in the direction of the sub-radius r and for each pulse of the rotary encoder 13 representing the minute angular displacement $\theta$ in the direction of the main radius R, and calculating the deviation d in the X direction of each section from the toric surface by means of a computer.

Concerning the positioning of the grinding wheel 5 with respect to the work 1, the air spindle 6 can slightly move within the holder 10 and the distance between the shaft of the air spindle 6 shaft and the air spindle swing shaft 9 is variable. The above-described conditions are always met even when the radius r' of the grinding wheel 5 is changed due to, for example, dressing of the grinding wheel 5. Namely, by virtue of the relationship of $R-r=l$ (constant), the rotary table 2 is always located at a position which is spaced by a distance l from the axis of the air spindle swing shaft 9. A standard gauge of a length R is extended from this position and the air spindle 6 is moved towards the air spindle swing shaft 9 so as to bring the grinding wheel 5 into contact with the reference gauge, whereby the above-described conditions are met. Actually, however, there is a fluctuating factor other than the reduction of the radius r' of the grinding wheel. More specifically, each work 1 has a grinding margin $\epsilon$ which varies according to the degree of the pre-processing. To eliminate any error attributable to this fluctuating margin, when the work 1 is set on the rotary table 2, the end of the reference gauge is formed as the probe of an electric micrometer and the distance between a reference position and the grinding surface on the work 1 is measured so as to determine the grinding margin $\epsilon$. Then, the rotary table 2 is retracted by the amount $\epsilon$ and is set at the retracted position and the grinding wheel 5 is located in the same manner as that described before by setting the gauge length to $R+\epsilon$. It is therefore possible to easily locate the work 1 and the grinding wheel 5 in such a manner as to eliminate any fluctuation attributable to the presence of the grinding margin $\epsilon$.

Figure 4:
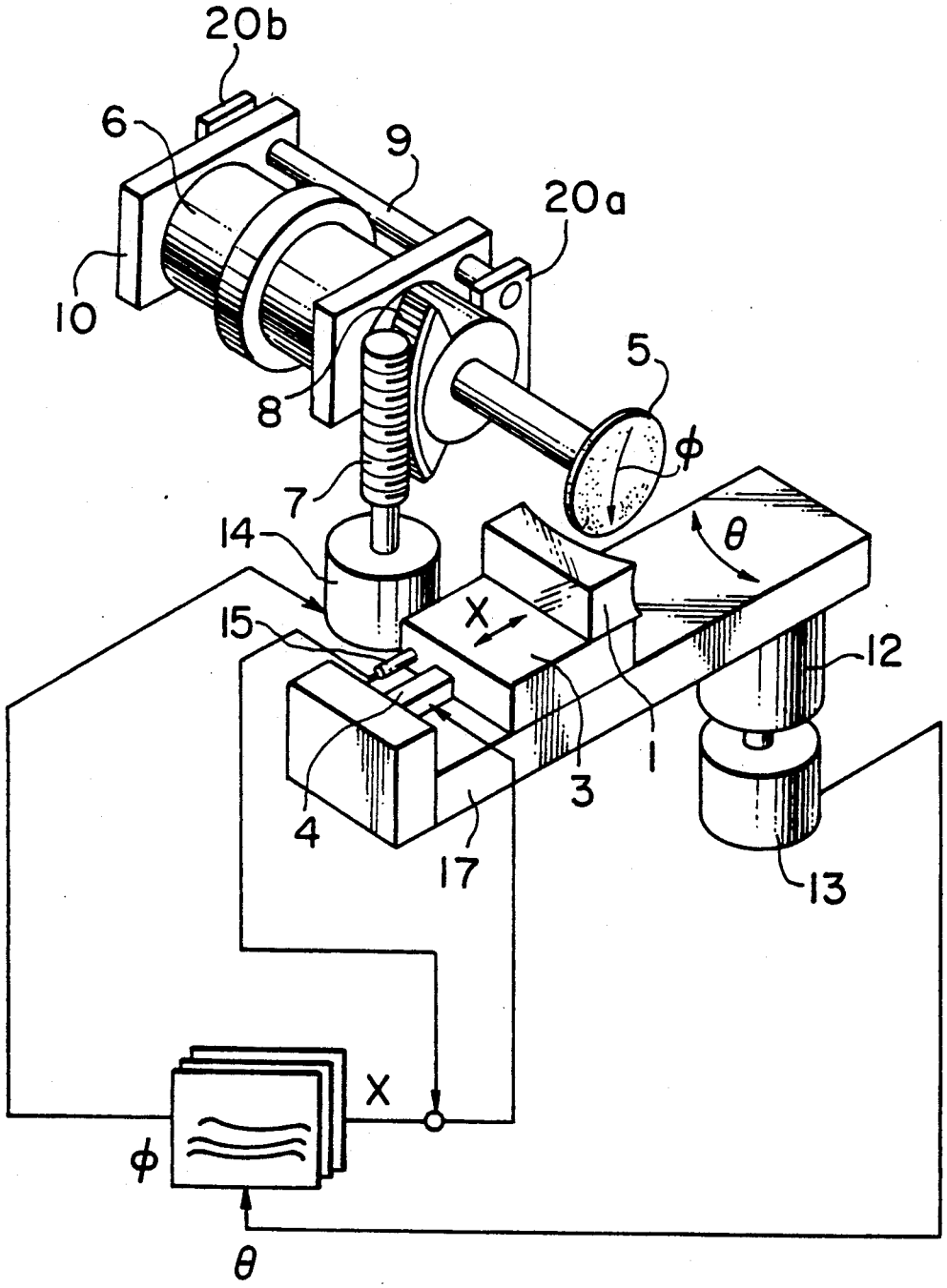
FIG. 4 is an illustration of another embodiment of the present invention suitable for grinding a concave surface.

Although an embodiment suitable for processing a convexed surface has been described, the present invention can equally be applied to the processing of a concaved aspheric surface as shown in FIG. 4. In FIG. 4, the same reference numerals are used to denote the same parts or members as those appearing in FIG. 1. In this case, however, a rocker table 17 is used in place of the rotary table used in the embodiment shown in FIG. 1. It will be clear also that the invention can effectively be applied not only to fabrication of lenses but also to fabrication of the lens mold.

In the embodiments described hereinbefore, the grinding wheel is arranged such that the axis about which the grinding wheel swings extends orthogonally to the axis of the rotary table. Such an arrangement, however, is not exclusive and the same effect can be produced by arranging such that the axis of the grinding wheel rocks within a plane which contains the axis of rotation.

While a preferred embodiment has been set forth along with modifications and variations to show specific advantageous details of the present invention, further embodiments, modifications and variations are contemplated within the broader aspects of the present invention, all as set forth by the spirit and scope of the following claims.

What is claimed is:

1. A method of operating apparatus for fabricating a similar toric surface having a main radius and a variable subradius on a lens or lens mold with a rotating tool that removes material from a workpiece, comprising:

rotating the workpiece about a first axis for determining the main radius of the surface with respect to the first axis;

rotating the tool about a second axis and removing material from the workpiece to form the surface;

moving the second axis of the tool about a third axis for determining the sub-radius of the surface, while maintaining the first and third axes orthogonal to each other and spaced apart;

storing processing data correlating the spacing to the rotation of the workpiece about the first axis; and varying the spacing between said first and third axes during said removing for a single workpiece in accordance with the processing data.

2. The method of claim 1, wherein said varying and removing removes all material from the workpiece by the tool in forming the surface for a single angular position of the tool relative to the third axis before performing said moving; and thereafter performing said step of moving and repeating all of said steps as reiterations until the entire surface is formed on the workpiece.

3. The method of claim 2, including carrying a plurality of workpieces on a table rotatable about the first axis and performing each iteration with respect to all of the workpieces on the table successively prior to performing the next iteration.

4. The method of claim 3, wherein said removing is performed by grinding the workpiece with a grinding tool.

5. The method of claim 4, further including:

producing first angle signals correlated to the angular position of the workpiece about the first axis;

storing processing data of the spacing as a function of the angular position of the workpiece about the first axis, with a different set of processing data for each angular position of the tool about the third axis;

reading out a control signal corresponding to the spacing from the processing data for the angular position of the tool about the third axis and in response to the angle signal for the angular position of the workpiece about the first axis; and relatively moving the first and third axis in accordance with the control signal corresponding to the spacing.

6. The method of claim 5, wherein said reading and relatively moving are performed for each regular incremental movement of a workpiece about the first axis.

7. The method of claim 1, wherein said removing is performed by grinding the workpiece with a grinding tool.

8. The method of claim 2, wherein said removing is performed by grinding the workpiece with a grinding tool.

9. The method of claim 1, further including:

producing first angle signals correlated to the angular position of the workpiece about the first axis;

storing processing data of the spacing as a function of the angular position of the workpiece about the first axis, with a different set of processing data for each angular position of the tool about the third axis;

reading out a control signal corresponding to the spacing from the processing data for the angular position of the tool about the third axis and in response to the angle signal for the angular position of the workpiece about the first axis; and relatively moving the first and third axis in accordance with the control signal corresponding to the spacing.

10. The method of claim 2, further including:

producing first angle signals correlated to the angular position of the workpiece about the first axis;

storing processing data of the spacing as a function of the angular position of the workpiece about the first axis, with a different set of processing data for each angular position of the tool about the third axis;

reading out a control signal corresponding to the spacing from the processing data for the angular position of the tool about the third axis and in response to the angle signal for the angular position of the workpiece about the first axis; and relatively moving the first and third axis in accordance with the control signal corresponding to the spacing.

11. The method of claim 3, further including:

producing first angle signals correlated to the angular position of the workpiece about the first axis;

storing processing data of the spacing as a function of the angular position of the workpiece about the first axis, with a different set of processing data for each angular position of the tool about the third axis;

reading out a control signal corresponding to the spacing from the processing data for the angular position of the tool about the third axis and in response to the angle signal for the angular position of the workpiece about the first axis; and relatively moving the first and third axis in accordance with the control signal corresponding to the spacing.

12. The method of claim 9, wherein said reading and relatively moving are performed for each regular incremental movement of a workpiece about the first axis.

13. The method of claim 10, wherein said reading and relatively moving are performed for each regular incremental movement of a workpiece about the first axis.

14. The method of claim 11, wherein said reading and relatively moving are performed for each regular incremental movement of a workpiece about the first axis.

* * * * *